US008774442B2

(12) United States Patent
Huang

(10) Patent No.: US 8,774,442 B2
(45) Date of Patent: Jul. 8, 2014

(54) EARPHONE SINGLE-SHAFT STRUCTURE

(71) Applicant: Jetvox Acoustic Corp., Taoyuan County (TW)

(72) Inventor: To-Teng Huang, Taoyuan County (TW)

(73) Assignee: Jetvox Acoustic Corp., Taoyuan, Taoyuan County (TW)

( * ) Notice: Subject to any disclaimer, the term of this patent is extended or adjusted under 35 U.S.C. 154(b) by 31 days.

(21) Appl. No.: 13/764,415

(22) Filed: Feb. 11, 2013

(65) Prior Publication Data

US 2014/0153766 A1 Jun. 5, 2014

(30) Foreign Application Priority Data

Dec. 3, 2012 (TW) ..... 101223393 A

(51) Int. Cl.
*H04R 25/00* (2006.01)
*H04R 1/10* (2006.01)

(52) U.S. Cl.
CPC ..... *H04R 1/105* (2013.01)
USPC ..... 381/374; 381/367; 381/370; 381/376; 381/379; 381/383

(58) Field of Classification Search
USPC ..... 381/367, 370, 374, 376, 379, 383
See application file for complete search history.

(56) References Cited

U.S. PATENT DOCUMENTS

2011/0116674 A1* 5/2011 Asakura et al. ..... 381/378

* cited by examiner

*Primary Examiner* — Davetta W Goins
*Assistant Examiner* — Amir Etesam
(74) *Attorney, Agent, or Firm* — Muncy, Geissler, Olds & Lowe, P.C.

(57) ABSTRACT

An earphone single-shaft structure includes a head strip, a cap body, and a single-shaft component. The single-shaft component is located at a housing of the cap body and connected to the head strip. The single-shaft component includes a body, a rotating shaft, a shaft hole, a pivot area and swinging areas. When the head strip rotates for a first angle about the pivot area, two ends of the head strip are located on one side of each swinging area, so that the cap body rotates in a first direction, and when the head strip rotates for a second angle about the pivot area, the two ends of the head strip are located on the other side of each swinging area, so that the cap body rotates in a second direction.

10 Claims, 12 Drawing Sheets

EARPHONE SINGLE-SHAFT STRUCTURE

CROSS-REFERENCES TO RELATED APPLICATIONS

This non-provisional application claims priority under 35 U.S.C. §119(a) on Patent Application No. 101223393 filed in Taiwan, R.O.C. on 2012 Dec. 3, the entire contents of which are hereby incorporated by reference.

BACKGROUND OF THE UTILITY MODEL

1. Technical Field

The utility model relates to an earphone structure, and more particularly to an earphone single-shaft structure.

2. Related Art

Currently, to make caps rotatable to fit on ears, a double-pivot structure is generally designed between the head-mounted member and the caps of the headphone, so that the caps are pivoted about the head-mounted member. However, the double-pivot structure generally only provides a single axial rotating direction, so that the caps cannot turn to an angle to better fit on the ears. Additionally, the design of the double-pivot structure generally needs to consider the coordination angle and structural matching with the caps and the head-mounted member, which brings inconvenience in processing.

Consequently, how to enhance the functionality of the structure based on the original fixed types of the earphone and provide a light and thin earphone structure is an issue to be solved in this field.

SUMMARY

Therefore, the utility model provides an earphone single-shaft structure, to solve the problem in the prior art that the caps have limited rotating directions caused by the double-pivot structure.

An embodiment of the utility model provides an earphone single-shaft structure, which includes a head strip, a cap body, and a single-shaft component. The single-shaft component is located at a housing of the cap body and connected to the head strip. The single-shaft component includes a body, a rotating shaft, a shaft hole, a pivot area and a plurality of swinging areas. The rotating shaft is located at one end of the body and pivotally connected to the housing. The shaft hole is located at the other end of the body and connected to the head strip. The pivot area is located at the center of the shaft hole. The swinging areas are located on two sides of the shaft hole. The width of the swinging area is larger than the width of the pivot area. When the head strip rotates for a first angle about the pivot area, two ends of the head strip are located on one side of each swinging area, so that the cap body rotates in a first direction, and when the head strip rotates for a second angle about the pivot area, the two ends of the head strip are located on the other side of each swinging area, so that the cap body rotates in a second direction.

In the utility model, the coordination between the shaft hole of the single-shaft component and the head strip enables the cap body to turn leftward and rightward to an angle to better fit on the ear. The body is combined with the housing of the cap body through a rotating shaft structure with a single side axle, so as to achieve the original functionality with the most simplified structure and obtain the greatest difference in the appearance. The diversified appearance of the material of the housing together with the metal head strip and body makes the appearance of the earphone of high quality.

BRIEF DESCRIPTION OF THE DRAWINGS

The utility model will become more fully understood from the detailed description given herein below for illustration only, and thus not limitative of the utility model, wherein.

DETAILED DESCRIPTION

Figure 1:
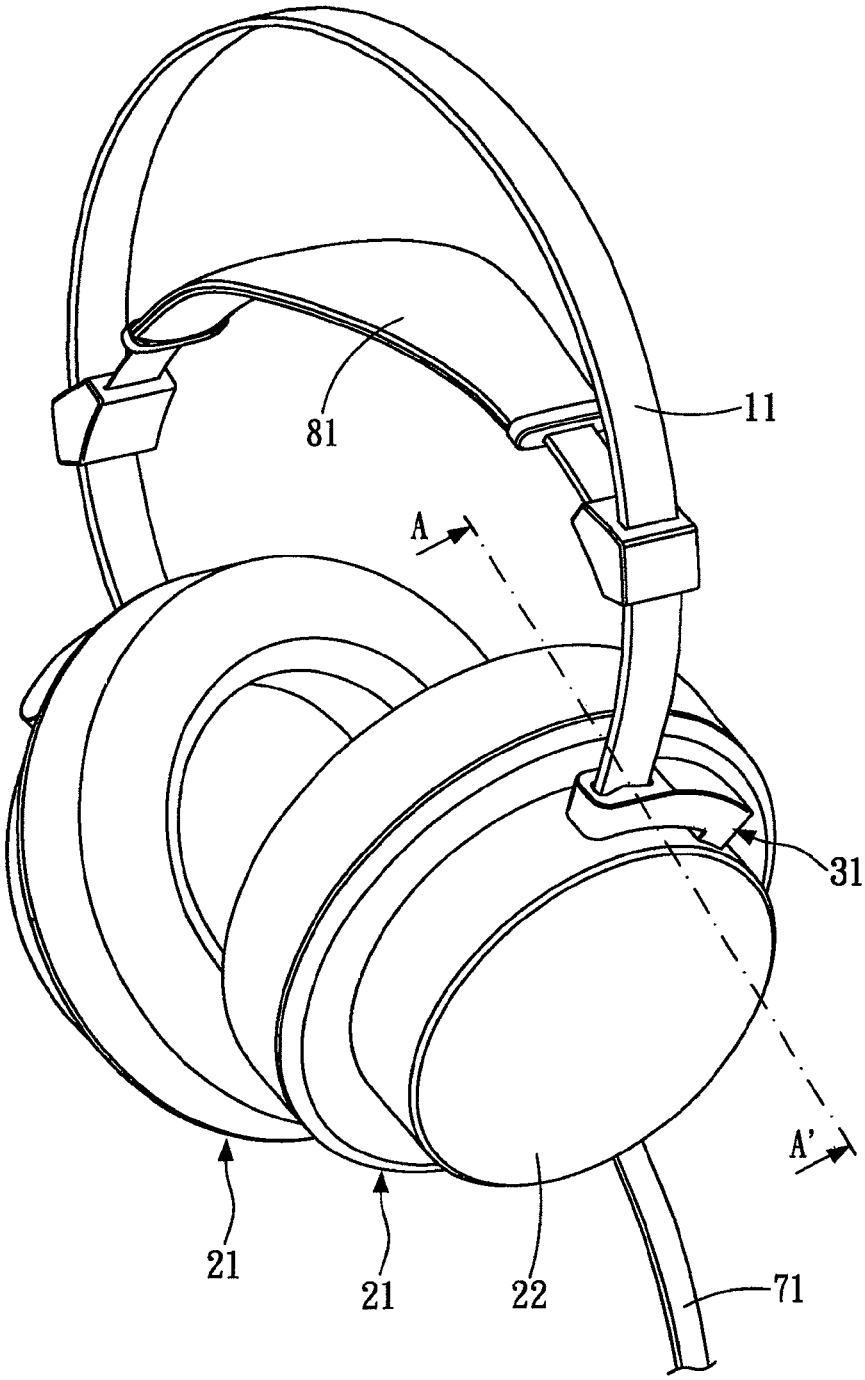
FIG. 1 is a schematic outside view of a first embodiment of the utility model.
Figure 2:
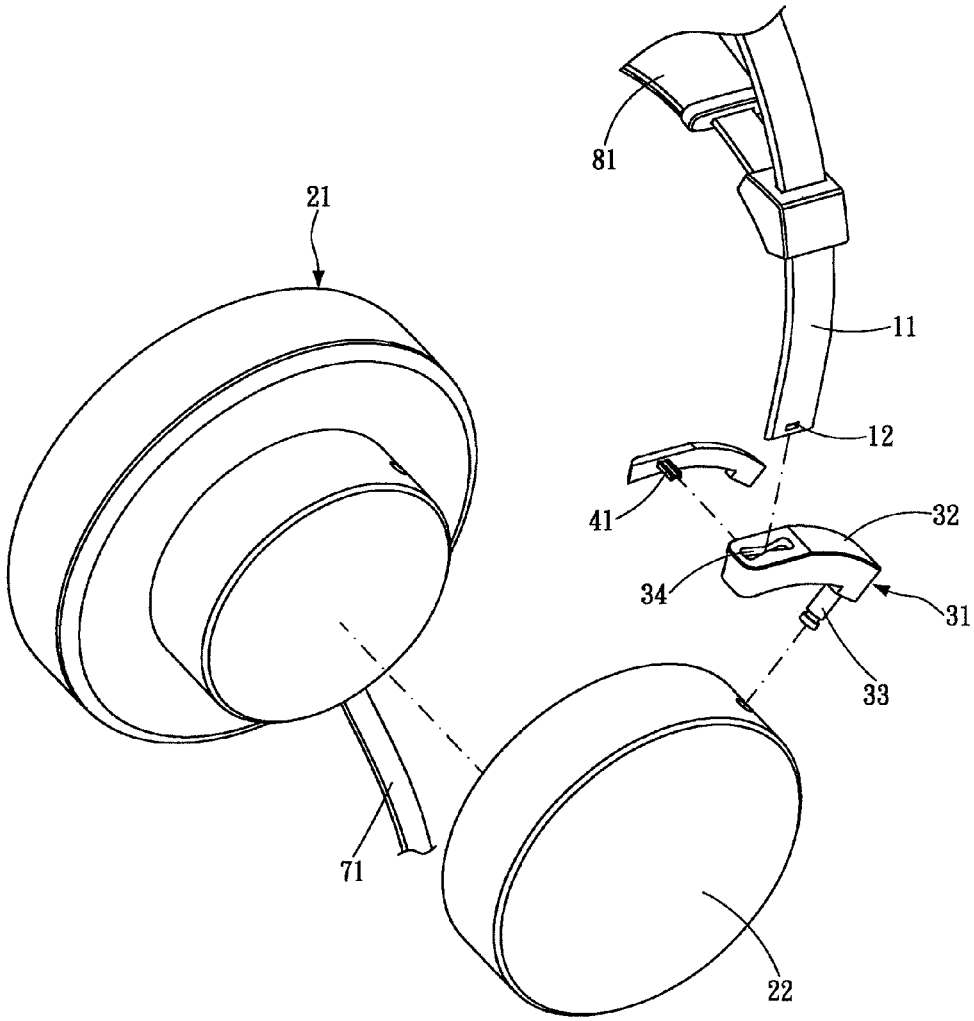
FIG. 2 is a first schematic partial exploded view of the first embodiment of the utility model.
Figure 3:
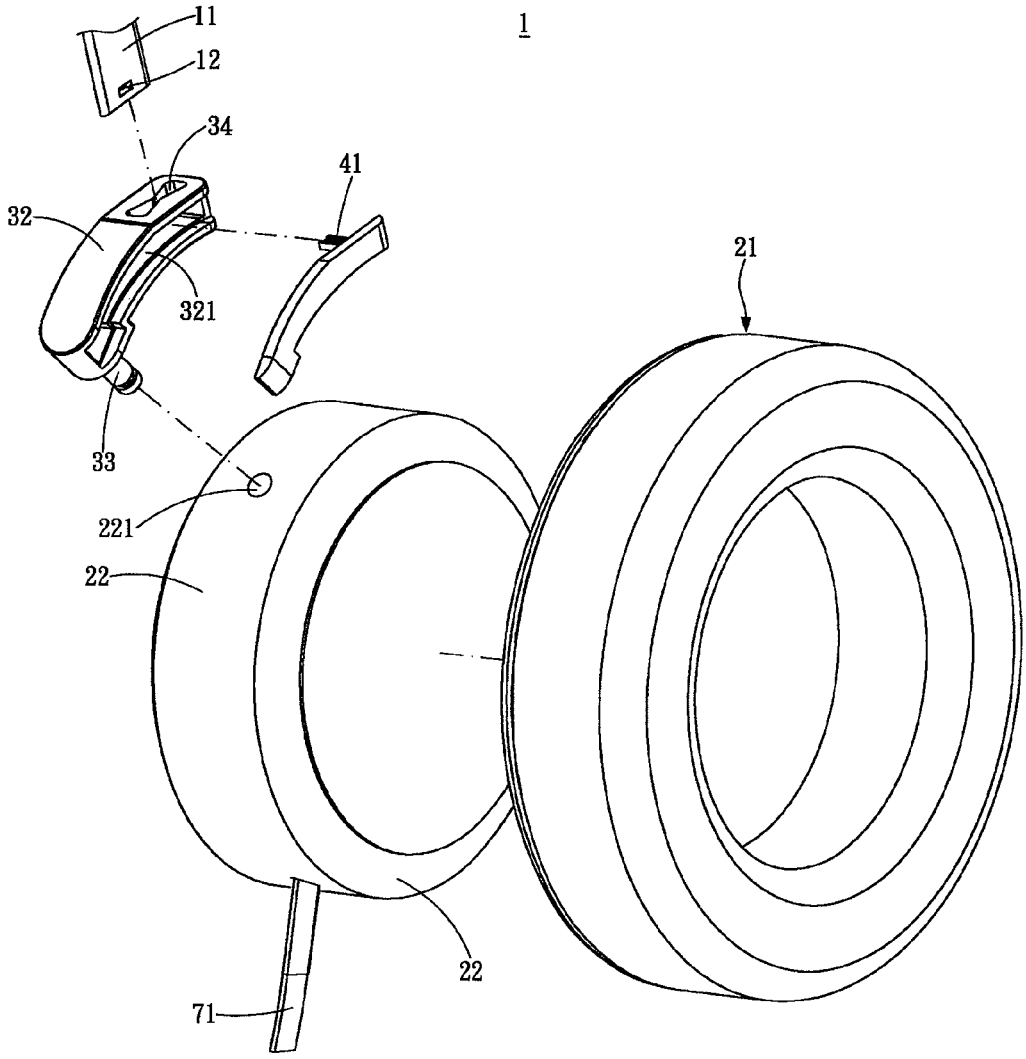
FIG. 3 is a second schematic partial exploded view of the first embodiment of the utility model.
Figure 4:
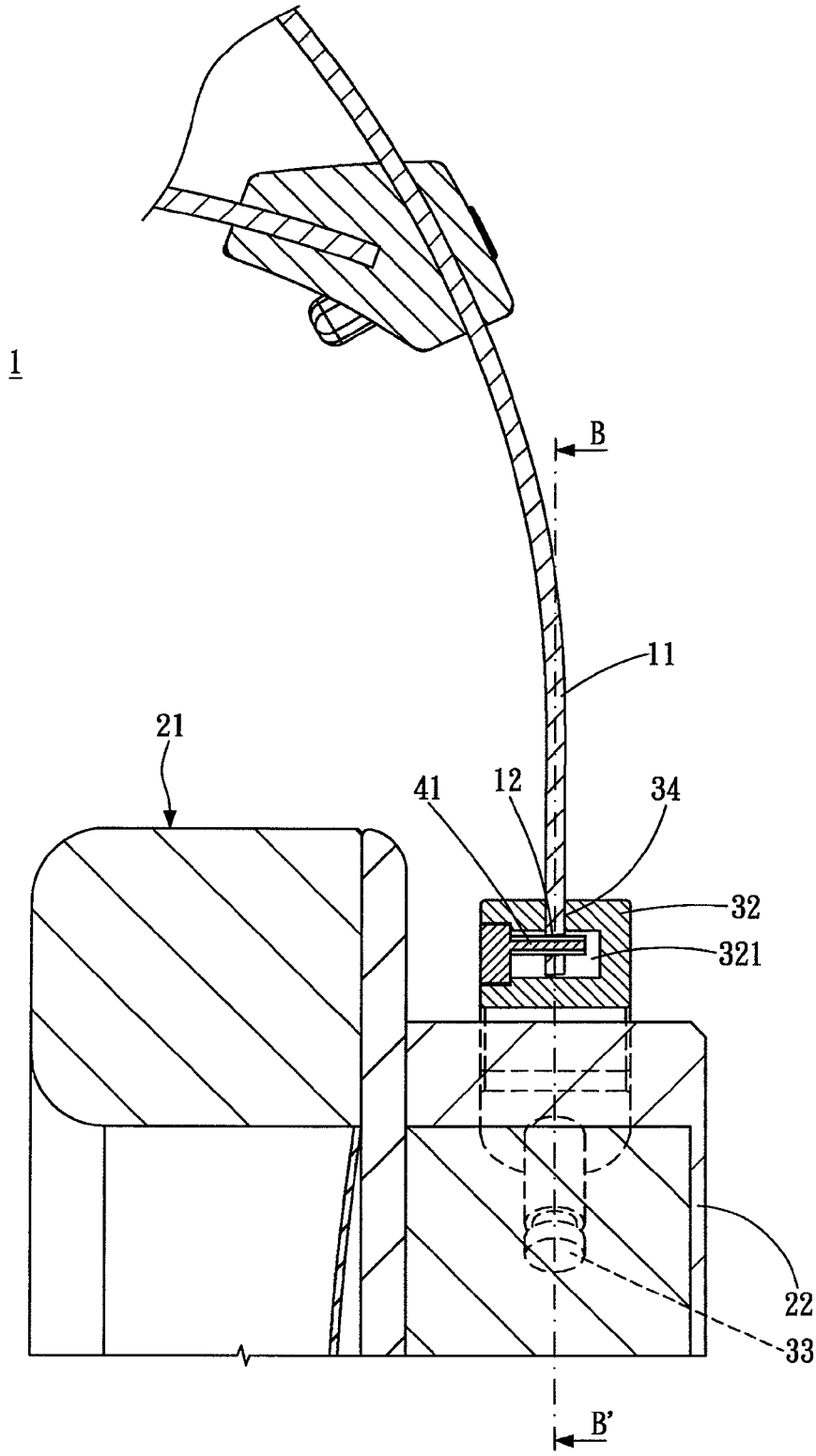
FIG. 4 is a schematic enlarged view of a cross-section along A-A' in FIG. 1.

FIG. 1 is a schematic outside view of a first embodiment of the utility model. FIG. 2 is a first schematic partial exploded view of the first embodiment of the utility model. FIG. 3 is a second schematic partial exploded view of the first embodiment of the utility model. FIG. 4 is a schematic enlarged view of a cross-section along A-A' in FIG. 1.

An earphone single-shaft structure 1 according to the embodiment of the utility model is a headphone, which includes a head strip 11, a cap body 21 and a single-shaft component 31.

Please refer to FIG. 1, in which the head strip 11 has an arc-shaped sheet structure. In this embodiment, the head strip 11 is made of metal, and the utility model is not limited thereto.

FIG. 2 and FIG. 3 show a part of the head strip 11 and one cap body 21. The cap body 21 is located on one side of the head strip 11, and includes a housing 22 and a single-body structure (not shown). In this embodiment, the housing 22 is made of, but not limited to, metal, wood or plastics. The cap body 21 is a round wrapper to fit on the ear. Please refer to FIG. 1, the left and right two cap bodies 21 are respectively a left sound track audio cap and a right sound track audio cap. In this embodiment, the earphone single-shaft structure 1 further includes a signal line 71 and a head band 81. The signal line 71 is connected to the housing 22 of the cap body 21, and the head band 81 is connected on two sides of the head strip 11.

Figure 7:
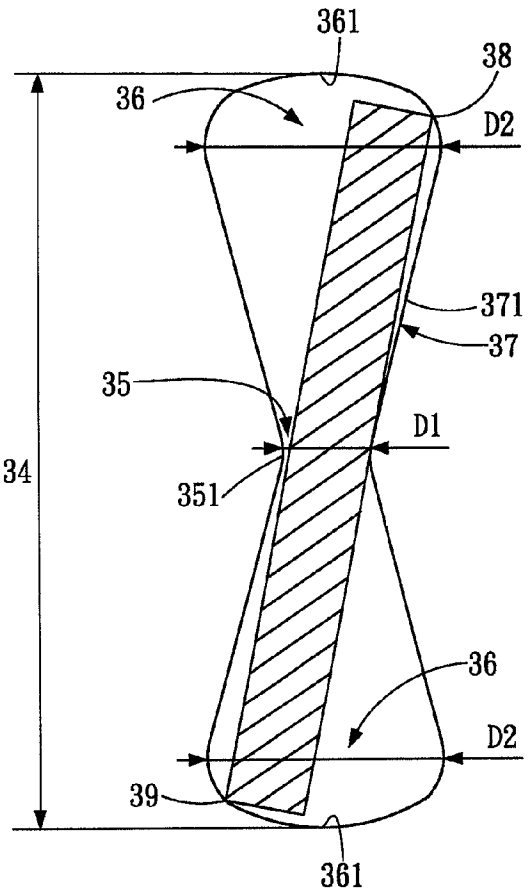
FIG. 7 is a schematic enlarged view of the combination of a shaft hole and a head strip in the utility model.

Please refer to FIG. 3 and FIG. 4, in which the single-shaft component 31 is located on the housing 22 and connected to the head strip 11, that is, the head strip 11 is connected to the housing 22 of the cap body 21 through the single-shaft component 31, and the single-shaft component 31 includes a body 32, a rotating shaft 33, a shaft hole 34, a pivot area 35 and swinging areas 36 (as shown in FIG. 7). In this embodiment, the single-shaft component 31 further includes a fixing member 41. The fixing member 41 has a rectangular structure, and penetrates the shaft hole 34 from a side end of the body 32. The head strip 11 further includes a buckling hole 12, located in the shaft hole 34 and pivotally connected to the fixing member 41 (as shown in FIG. 5).

Figure 6:
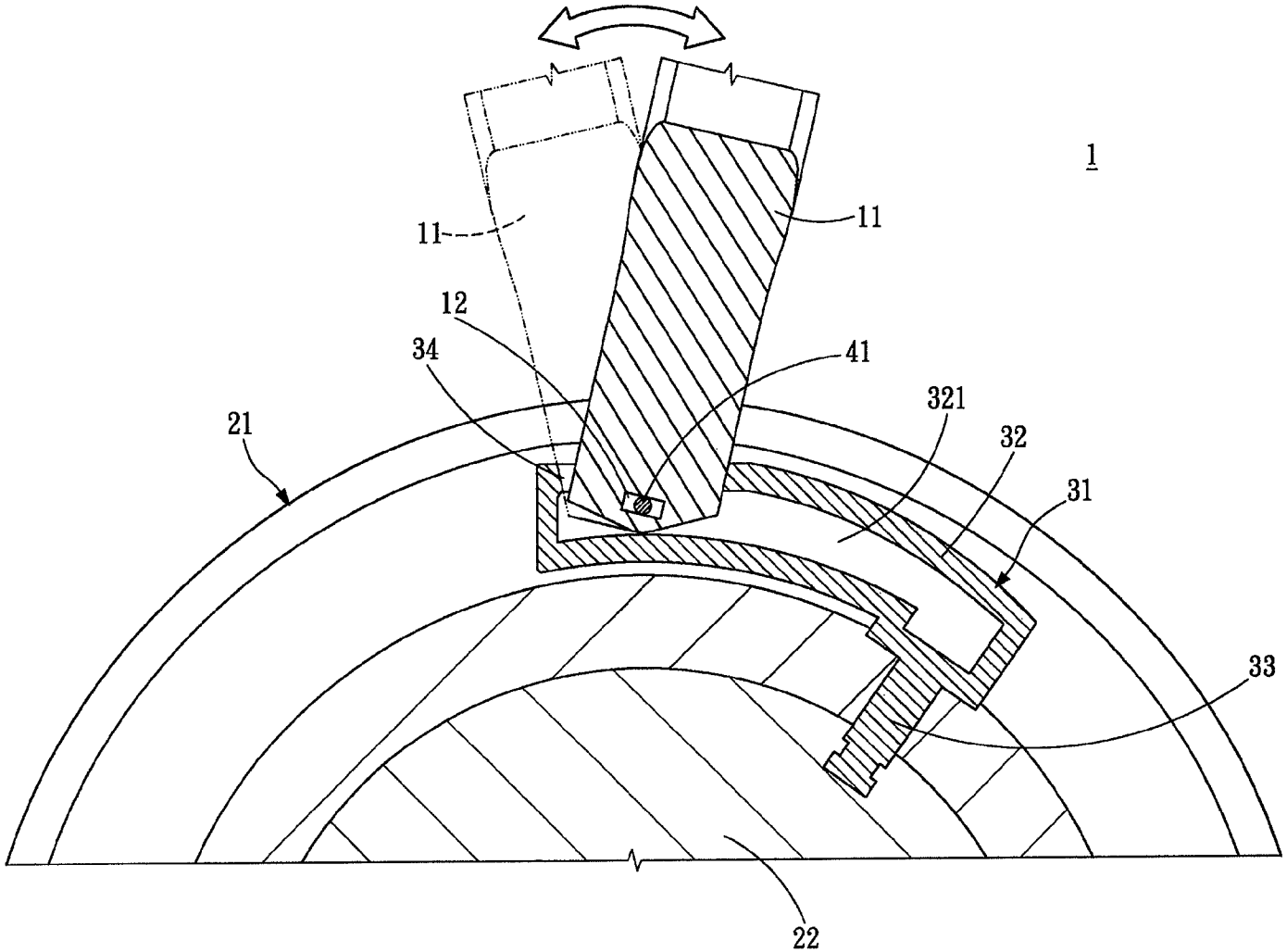
FIG. 6 is a schematic outside view of another aspect of a fixing member in the utility model.

It is only exemplary that the fixing member 41 has a rectangular structure, and in some embodiment, the fixing member 41 has a round shaft structure, so that the head strip 11 is enabled to rotate about the fixing member 41 (as shown in FIG. 6).

Figure 5:
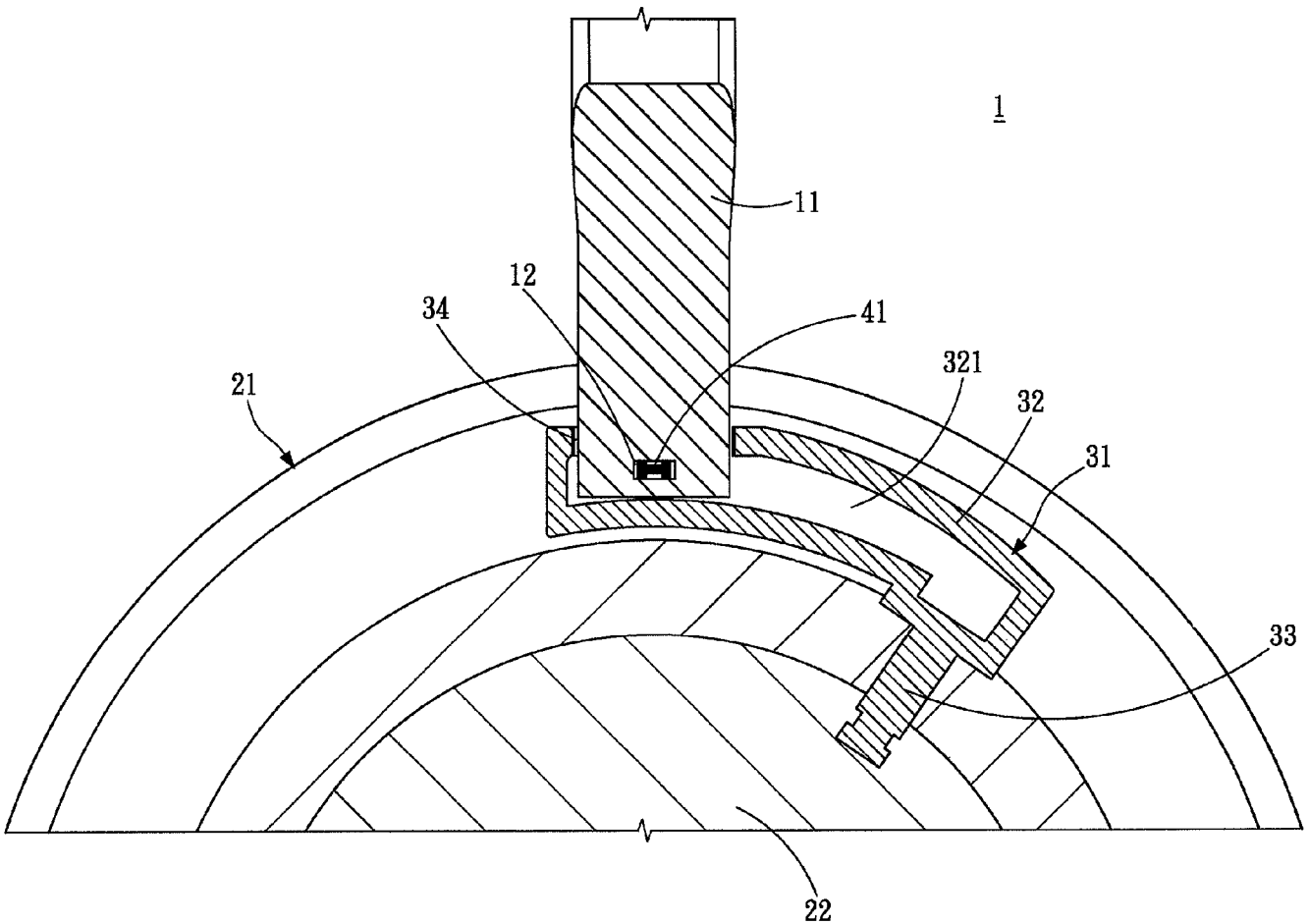
FIG. 5 is a schematic enlarged view of a cross-section along B-B' in FIG. 4.

Please refer to FIG. 3 and FIG. 5, in which the body 32 has a curved structure attached to a surface of the housing 11. In this embodiment, a groove 321 is formed on a side surface of the body 32. The rotating shaft 33 is located at one end of the body 32 and pivotally connected to the housing 22. The rotating shaft 33 has a column structure penetrating a through-hole 221 on the surface of the housing 22.

Please refer to FIG. 3 and FIG. 4, in which the shaft hole 34 is located at the other end of the body 32 and connected to the head strip 11, that is, the structures of the shaft hole 34 and the rotating shaft 33 are respectively disposed on two sides of the body 32. The shaft hole 34 is opened on an upper surface of the body 32 and penetrates the groove 321 of the body 32. The rotating shaft 33 is located on a lower surface of the body 32.

Figure 8:
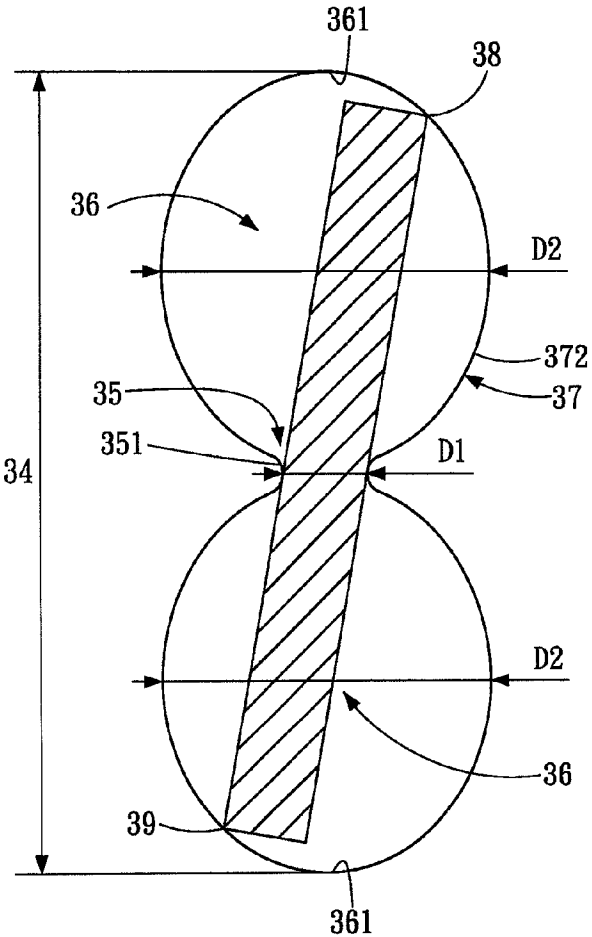
FIG. 8 is a first schematic enlarged view of another aspect of the shaft hole in the utility model.
Figure 10:
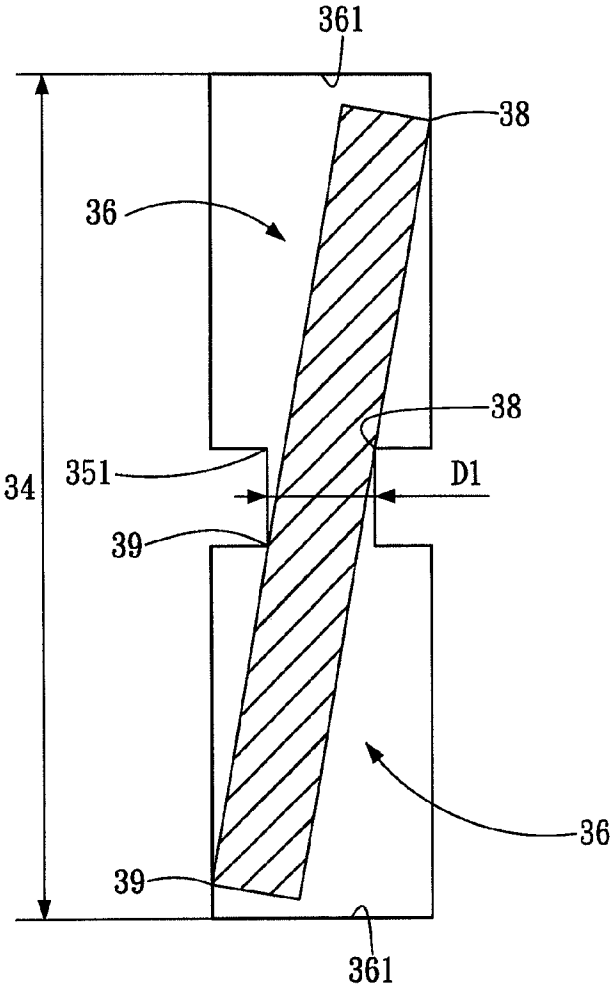
FIG. 10 is a third schematic enlarged view of another aspect of the shaft hole in the utility model.

Please refer to FIG. 7, in which embodiment the structure of the shaft hole 34 includes the pivot area 35 and the swinging areas 36, and the pivot area 35 and the swinging areas 36 form a figure-8-shaped slot hole structure. The pivot area 35 is located at the center of the shaft hole 34 and has a width D1 of a narrow spacing. The pivot area 35 has two facing curved protruding portions 351 (as shown in FIG. 7 and FIG. 8), and the utility model is not limited thereto. In some implementation aspects, the pivot area 35 has two facing protruding portions 351 of perpendicular corners (as shown in FIG. 10). The two protruding portions 351 are spaced by the width D1.

Figure 9:
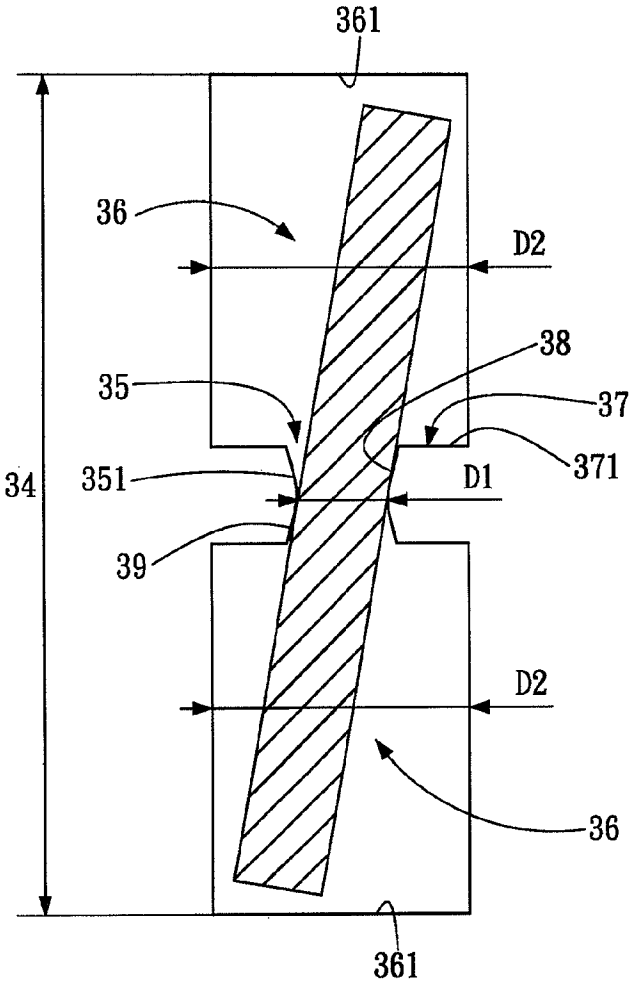
FIG. 9 is a second schematic enlarged view of another aspect of the shaft hole in the utility model.

Please refer to FIG. 7, in which the swinging areas 36 are located on two sides of the shaft hole 34 and each have a width D2 of a large spacing. In this embodiment, each swinging area 36 has a curved recessed portion 361, and the utility model is not limited thereto. In some implementation aspects, each swinging area 36 has a recessed portion 361 of perpendicular corners (as shown in FIG. 9). The two recessed portions 361 of the two swinging areas 36 are disposed facing each other, that is, the two recessed portions 361 are perpendicular to the two protruding portions 351. In this embodiment, the two sides of the inner diameter of the recessed portion 361 are spaced by the width D2 (as shown in FIG. 7). The pivot area 35 is located at the center of the shaft hole 34, the two swinging areas 36 are respectively located on two sides of the pivot area 35, and the width D2 of the swinging area 36 is larger than the width D1 of the pivot area 35.

Please refer to FIG. 7, in which embodiment a connecting portion 37 is disposed at the junction between the swinging area 36 and the pivot area 35, and the connecting portion 37 is formed with an inclined plane. Two sides of the connecting portion 37 are respectively connected to the recessed portion 361 of the swinging area 36 and the protruding portion 351 of the pivot area 35. The width of the junction between the swinging area 36 and the pivot area 35 is smaller than the width of the other end. In this embodiment, the width of one end of the swinging area 36 connected to the pivot area 35 is gradually increased toward the other end (that is, the inclined plane is gradually expanded).

It is only exemplary that the connecting portion 37 is formed with the inclined plane 371, and in some embodiment, the connecting portion 37 is formed with a curved camber 372 (as shown in FIG. 8). In some embodiment, the connecting portion 37 is formed with a plane 371 of perpendicular corners (as shown in FIG. 9). The width of one end of the swinging area 36 connected to the pivot area 35 is not gradually increased toward the other end.

Please refer to FIG. 7, in which the single-shaft component 31 further includes a first urging surface 38 and a second urging surface 39. The first urging surface 38 is located on one side of the shaft hole 34 and urges against one side of the head strip 11. The second urging surface 39 is located on the other side of the shaft hole 34 and urges against the other side of the head strip 11. In this embodiment, the first urging surface 38 and the second urging surface 39 are located in the swinging areas 36, and the utility model is not limited thereto. In some implementation aspects, the first urging surface 38 and the second urging surface 39 are located on two sides of the pivot area 35 (as shown in FIG. 9). In some implementation aspects, the first urging surface 38 and the second urging surface 39 are located in the pivot area 35 and the swinging areas 36 (as shown in FIG. 10).

Figure 11:
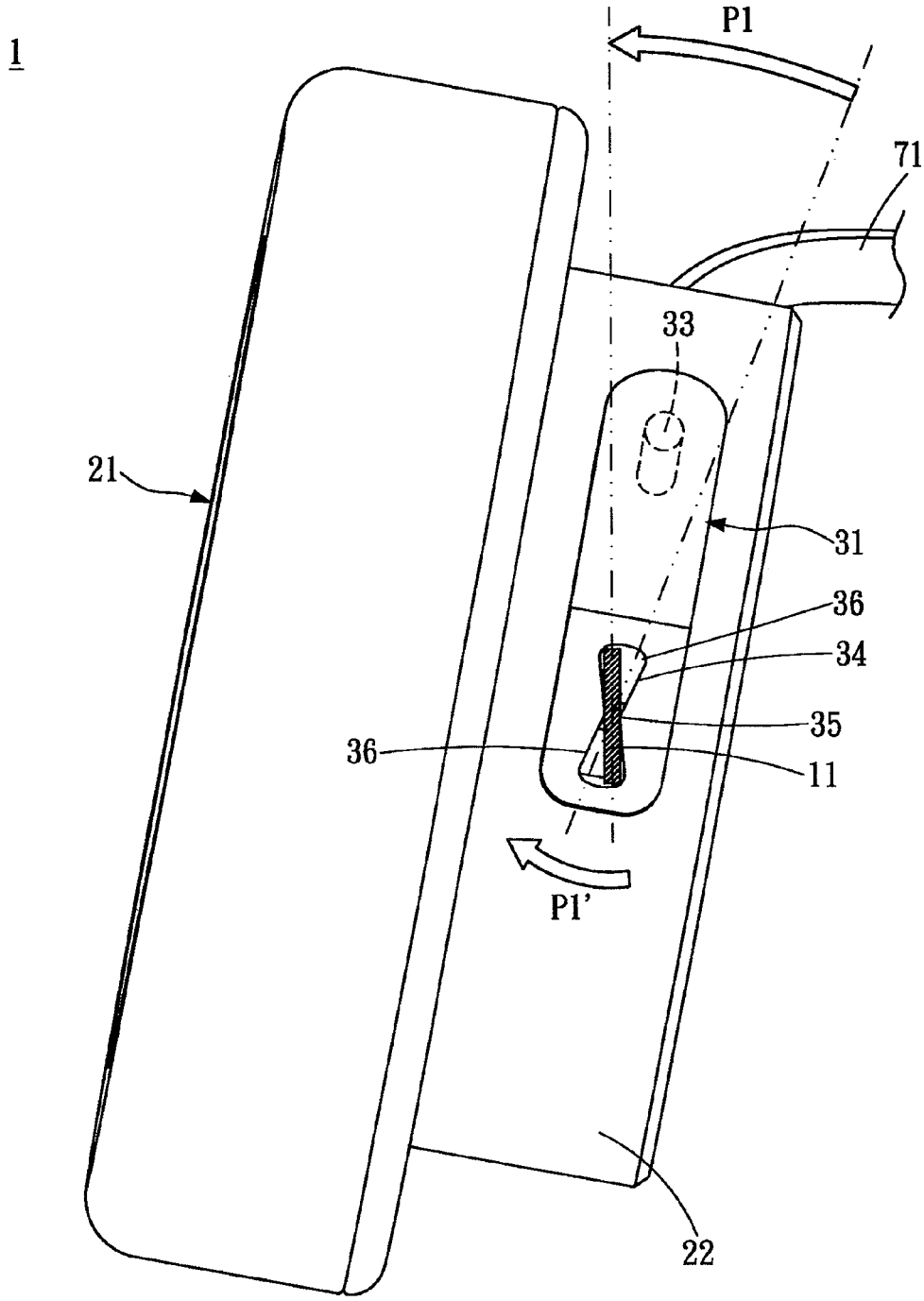
FIG. 11 is a first schematic enlarged view of the utility model when the head strip and the shaft hole are in operation.
Figure 12:
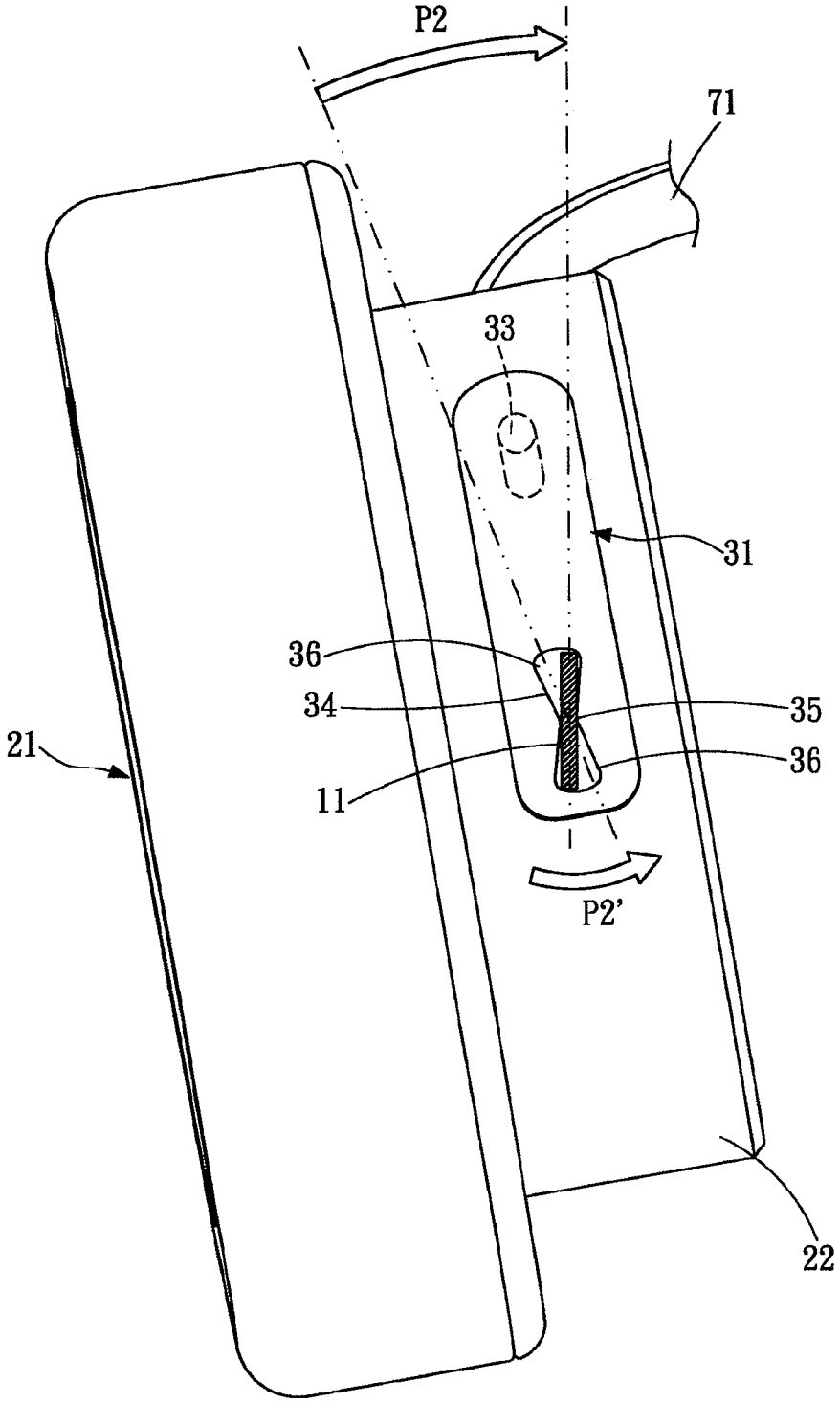
FIG. 12 is a second schematic enlarged view of the utility model when the head strip and the shaft hole are in operation.

FIG. 11 and FIG. 12 show the operating mode of the head strip 11 and the shaft hole 34 in rotation.

FIG. 11 is a top view of the structure of one earphone cap body 21 and is a schematic view of the cross-section of the head strip 11 (that is, the section line area in the figure), in which the head strip 11 is positioned in the shaft hole 34. When the head strip 11 rotates for a first angle P1 (marked by the upper arrow in the figure), about the pivot area 35, the two ends of the head strip 11 are located on one side of each swinging area 36, so that the cap body 21 rotates in a first direction P1' (marked by the lower arrow in the figure), that is, the head strip 11 urges against the inner wall of the shaft hole 34. One end of the head strip 11 is located on the left side of one swinging area 36, and the other end of the head strip 11 is located on the right side of the other swinging area 36. In other words, after putting on the earphone, the user can adjust the cap body 21 to better fit on the ear. When the head strip 11 is located at a fixed angle, the cap body 21 and the single-shaft component 31 can be further adjusted to rotate to make the swinging areas 36 of the shaft hole 34 swing by the first angle P1, so that the cap body 21 rotates in the first direction P1'. Thereby, the cap body 21 is adjusted to an angle to better fit on the ear.

Please refer to FIG. 12, in which the difference from FIG. 11 is that, the cap body 21 rotates in another direction in FIG. 12. When the head strip 11 rotates for a second angle P2 (marked by the upper arrow in the figure) about the pivot area 35, the two ends of the head strip 11 are respectively located on different sides of the upper and lower swinging areas 36, so that the cap body 21 rotates in a second direction P2' (marked by the lower arrow in the figure). Thereby, the cap body 21 is adjusted to an angle to better fit on the ear.

Figure 13:
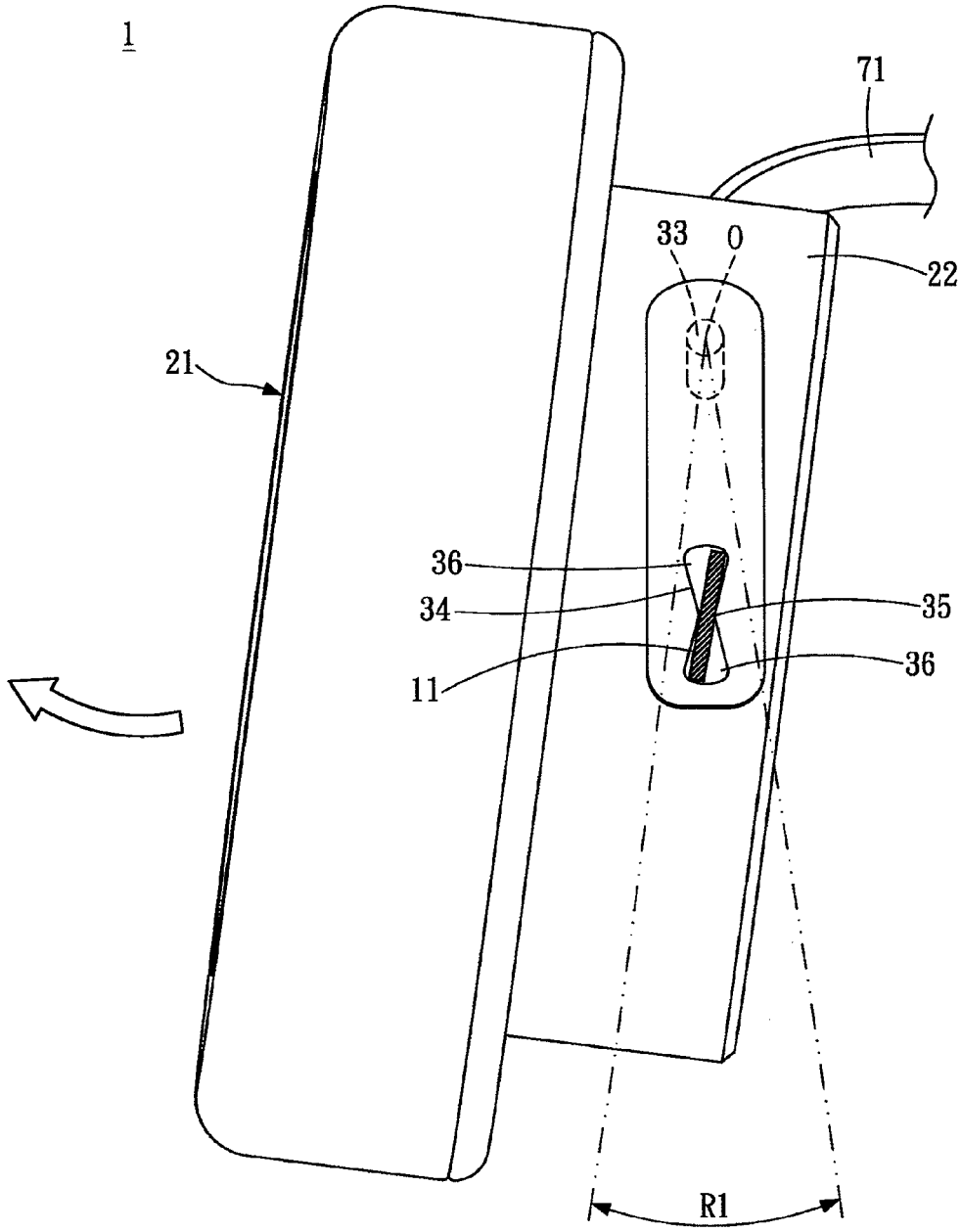
FIG. 13 is a first schematic enlarged view of the utility model when a cap body and a rotating shaft are in operation.
Figure 14:
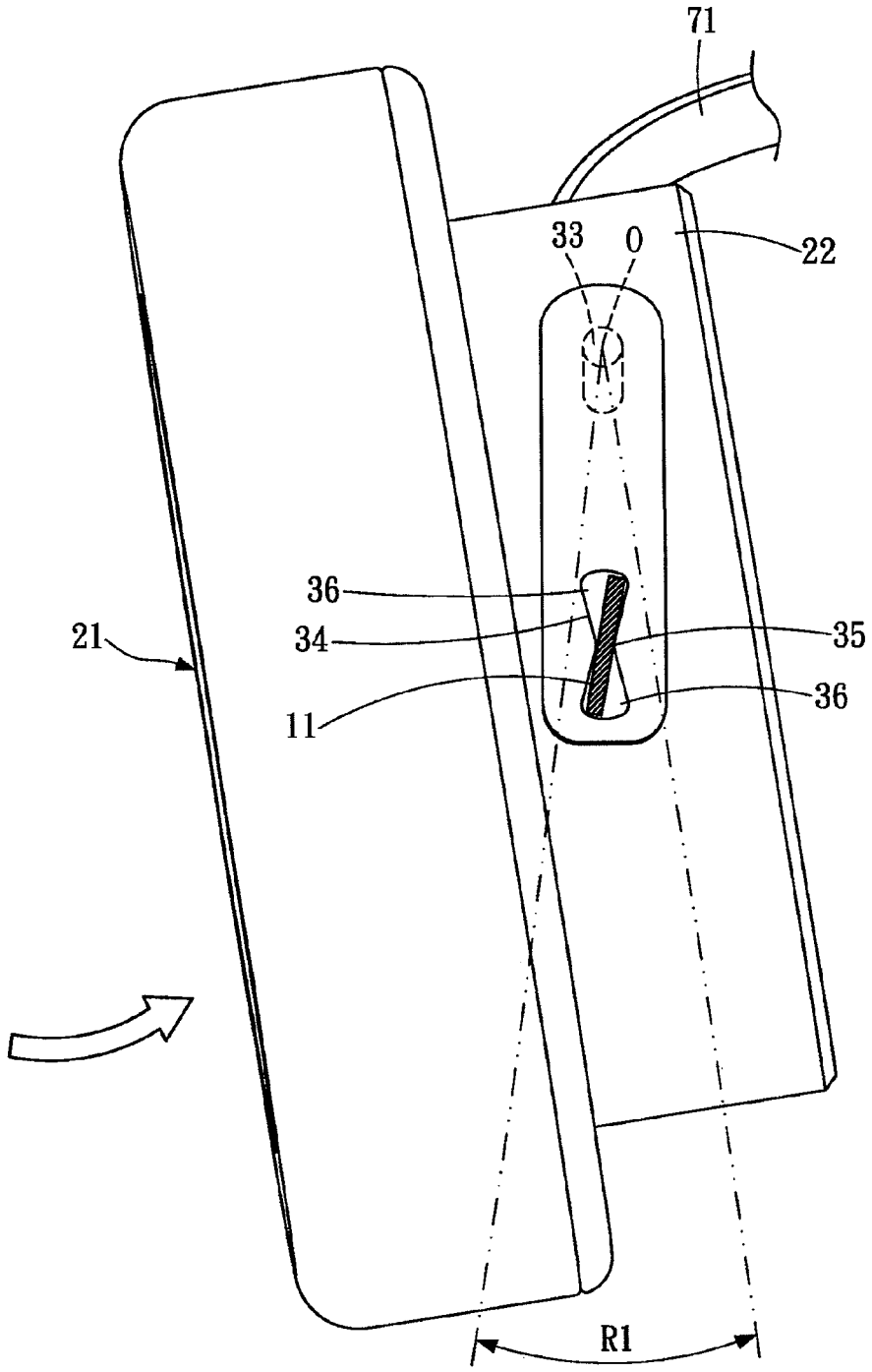
FIG. 14 is a second schematic enlarged view of the utility model when the cap body and the rotating shaft are in operation.

FIG. 13 and FIG. 14 show the operating mode of the cap body 21 and the rotating shaft 33 in rotation.

Please refer to FIG. 13 and FIG. 14, in which the cap body 21 rotates about the rotating shaft 33. The cap body 21 is capable of rotating leftward and rightward with the rotating shaft 33 as a central shaft O for a predetermined angle R1 (marked by the arrow in the figure). Thereby, the cap body 21 is adjusted to an angle to better fit on the ear.

In view of the above, the coordination between the shaft hole of the single-shaft component and the head strip enables the cap body to turn leftward and rightward to an angle to better fit on the ear. The body is combined with the housing of the cap body through a rotating shaft structure with a single side axle, so as to achieve the original functionality with the most simplified structure and obtain the greatest difference in the appearance. The diversified appearance of the material of the housing together with the metal head strip and body makes the appearance of the earphone of high quality.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An earphone single-shaft structure, comprising:

a head strip;

a cap body, located on one side of the head strip, and comprising a housing; and a single-shaft component, located at the housing and connected to the head strip, and comprising:

a body;

a rotating shaft, located at one end of the body and pivotally connected to the housing;

a shaft hole, located at the other end of the body and connected to the head strip;

a pivot area, located at the center of the shaft hole; and a plurality of swinging areas, located on two sides of the shaft hole, the width of the swinging area being larger than the width of the pivot area, wherein when the head strip rotates for a first angle about the pivot area, two ends of the head strip are located on one side of each swinging area, so that the cap body rotates in a first direction, and when the head strip rotates for a second angle about the pivot area, the two ends of the head strip are located on the other side of each swinging area, so that the cap body rotates in a second direction.

2. The earphone single-shaft structure according to claim 1, wherein the width of the junction between the swinging area and the pivot area is smaller than the width of the other end.

3. The earphone single-shaft structure according to claim 1, wherein the width of one end of the swinging area connected to the pivot area is gradually increased toward the other end.

4. The earphone single-shaft structure according to claim 1, wherein the single-shaft component further comprises a first urging surface and a second urging surface, the first urging surface is located on one side of the shaft hole and urges against one side of the head strip, and the second urging surface is located on the other side of the shaft hole and urges against the other side of the head strip.

5. The earphone single-shaft structure according to claim 4, wherein the first urging surface and the second urging surface are located on two sides of the pivot area.

6. The earphone single-shaft structure according to claim 4, wherein the first urging surface and the second urging surface are located in the swinging areas.

7. The earphone single-shaft structure according to claim 1, wherein the cap body rotates for an angle about the rotating shaft.

8. The earphone single-shaft structure according to claim 1, wherein the single-shaft component further comprises a fixing member penetrating the shaft hole, the head strip comprises a buckling hole, and the buckling hole is located in the shaft hole and pivotally connected to the fixing member.

9. The earphone single-shaft structure according to claim 1, further comprising a signal line, connected to the housing of the cap body.

10. The earphone single-shaft structure according to claim 1, further comprising a head band, connected on two sides of the head strip.

* * * * *